US008416047B2

(12) United States Patent
Weekamp et al.

(10) Patent No.: US 8,416,047 B2
(45) Date of Patent: Apr. 9, 2013

(54) INDUCTIVE COMPONENTS FOR DC/DC CONVERTERS AND METHODS OF MANUFACTURE THEREOF

(75) Inventors: Johannes Wilhelmus Weekamp, Beek en Donk (NL); Eric Cornelis Egertus van Grunsven, Someren (NL); Hendrik Johannes Bergveld, Eindhoven (NL); Franciscus Adrianus Cornelis Maria Schoofs, Valkenswaard (NL)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 12/762,177

(22) Filed: Apr. 16, 2010

(65) Prior Publication Data

US 2010/0265030 A1 Oct. 21, 2010

(30) Foreign Application Priority Data

Apr. 17, 2009 (EP) ..... 09100237

(51) Int. Cl.
*H01F 5/00* (2006.01)

(52) U.S. Cl. ..... 336/200

(58) Field of Classification Search ..... 336/65, 336/83, 200, 232; 257/531
See application file for complete search history.

(56) References Cited

U.S. PATENT DOCUMENTS

| | | | | |
|---|---|---|---|---|
| 5,694,030 | A | 12/1997 | Sato et al. | |
| 6,593,841 | B1 * | 7/2003 | Mizoguchi et al. | 336/200 |
| 6,618,929 | B2 * | 9/2003 | Kitamura | 29/602.1 |
| 6,828,670 | B2 | 12/2004 | Hayama et al. | |
| 6,831,543 | B2 * | 12/2004 | Mizoguchi et al. | 336/200 |
| 7,141,874 | B2 | 11/2006 | Nakatani | |
| 7,161,371 | B2 | 1/2007 | Higashitani et al. | |
| 2006/0214759 | A1 | 9/2006 | Kawarai | |
| 2007/0030659 | A1 | 2/2007 | Suzuki et al. | |
| 2007/0085647 | A1 | 4/2007 | Kawarai | |

FOREIGN PATENT DOCUMENTS

| | | | |
|---|---|---|---|
| EP | 1 705 672 | A2 | 9/2006 |
| JP | 09-084334 | A | 3/1997 |
| JP | 2000-243637 | A | 9/2000 |

OTHER PUBLICATIONS

European Search Report for EP Patent Appln. No. EP 09 10 0237.8 (Jan. 29, 2010).
Extended European Search Report (EESR), for EP Application 09100237.8 dated Jan. 29, 2010.

* cited by examiner

*Primary Examiner* — Tuyen Nguyen

(57) ABSTRACT

An inductive component for a DC/DC converter is made by transferring a copper track (2) from a copper substrate (1) to a first ferrite plate (3). A second ferrite plate (5) is attached by glue to the first ferrite plate so that the track (2) forms an inductor coil sandwiched between the two ferrite plates (3,5). One of the plates has holes (4) in registration with the terminals of the coil, and these holes are filled with solder (5) to provide externally accessible contacts.

20 Claims, 16 Drawing Sheets

(g)

(h)

INDUCTIVE COMPONENTS FOR DC/DC CONVERTERS AND METHODS OF MANUFACTURE THEREOF

Figure 1:
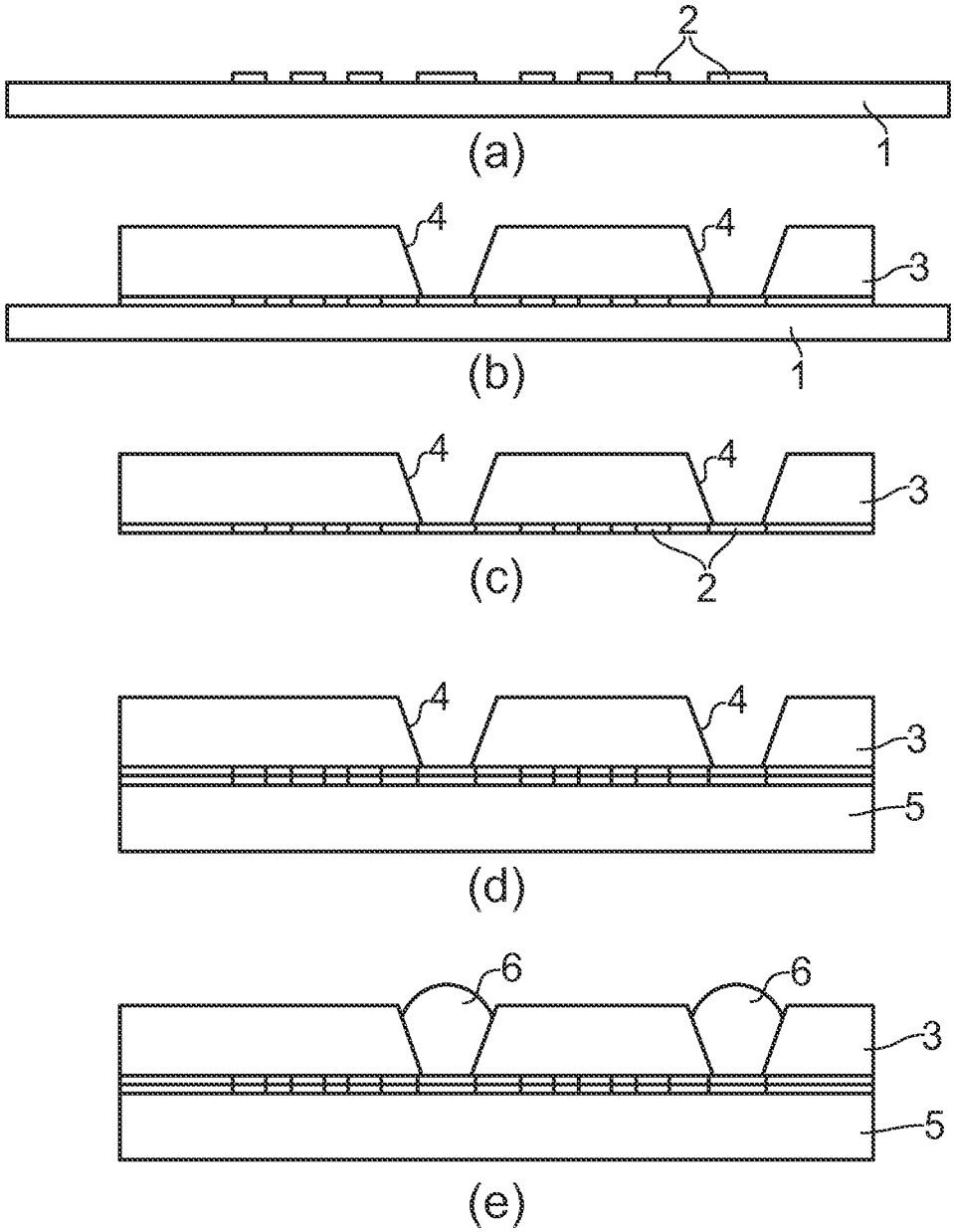

This invention relates to inductive components for DC/DC converters and to methods of manufacture of such components.

The number of supply voltages that need to be derived from a battery voltage for various system parts in a portable electronic device has increased dramatically over the years. Since run times of portable battery-powered devices also need to be long, deriving the needed supply voltages from the battery voltage needs to be done in an efficient way. Several methods exist for deriving one voltage from another, and two groups can be recognized: time-continuous voltage converters (or linear regulators) and time-discrete voltage converters.

In a time-continuous converter (or linear regulator) a transistor is used as a dissipative element. Clear disadvantages are that only voltage down conversion is possible and that the efficiency of the converter is limited to the ratio of output voltage and input voltage of the voltage converter, Vout/Vin.

In a time-discrete converter a passive component, a capacitor or an inductor, is used as an energy-storage element. The energy-storage element is first connected to the input source to store energy, after which it is connected to the load to release the energy. The two main sub-types are capacitive and inductive converters, depending on which type of passive component is used to store energy temporarily. For both types, up conversion as well as down conversion is possible.

Capacitive converters have the disadvantage that the ratio between output voltage and input voltage is determined by the topology and cannot be controlled easily, except by combining several switchable topologies in one circuit which severely adds to the number of components. Moreover, continuous control of the output voltage as the input voltage or output current varies is only possible in a dissipative manner, e.g. by frequency control, duty-cycle control or adding a series linear regulator. This is not acceptable for most applications, since it negatively influences the efficiency. Moreover, to keep the efficiency acceptable rather large capacitors are needed.

Inductive converters have the advantage that controlling the duty cycle at which the power switches, that control the storage and release of energy in the inductor, are addressed can control the output voltage rather easily and efficiently. Therefore, the output voltage, i.e. the supply voltage to a certain system block, can be kept constant when the input voltage, i.e. the battery voltage, varies. Relatively high efficiencies are possible for relatively high output powers compared to capacitive converters. Therefore, this patent application is concerned with inductive components for inductive DC/DC converters.

Most state-of-the-art DC/DC converters use external inductors to build a complete DC/DC converter, the power switches and control circuits being implemented on an Integrated Circuit (IC). A disadvantage of this is that with an increasing number of voltages to be generated in a system, the occupied Printed Circuit Board (PCB) space increases dramatically, since the external inductors take up quite some space. This patent application deals with integrating the inductor needed for a DC/DC converter into the IC package.

Several approaches exist in integrating the inductor and the IC with power switches and control circuitry in a single package. The main issues in this respect are achieving a relatively large inductance with a low series resistance, i.e. a large L/R ratio at the frequency of interest (also referred to as quality factor) and at the lowest possible volume. It should be noted that in addition to quality factor, which is an important metric for inductors used in Radio-Frequency (RF) applications, the DC resistance is also important for DC/DC-converter applications. The reason is that the inductor current has both a DC and AC component. The latter component is referred to as ripple current. Shielding of magnetic flux lines is also an issue due to Electro-Magnetic Interference (EMI) problems. Further, in order to make integrated DC/DC converters a viable alternative, the cost of the fabricated integrated inductors should be low.

Using air coils implemented in the lead frame or on e.g. a passive-integration silicon substrate has the advantage that the inductance remains relatively constant as a function of frequency. Moreover, saturation, i.e. a decrease in inductance when the current through the coil increases, does not occur, such that the same inductance value is maintained over the complete range of coil currents. However, a big disadvantage of air coils is the fact that flux lines are not contained. Therefore, in an integrated DC/DC converter using air coils these flux lines will also penetrate the active die on which sensitive electronic circuits are present. This EMI problem will introduce many practical problems. Moreover, achievable inductance values are relatively low for air coils, resulting in the need for a rather high switching frequency for the DC/DC converter for a certain specified output power. High switching frequencies will lead to relatively high switching losses reducing the efficiency. Reducing these relatively high switching losses is difficult in practical circuits.

Using magnetic material to guide the flux lines and to offer a low-reluctance path helps to increase the inductance for the same winding structure and to solve the EMI problem, since the flux lines remain contained in the magnetic material used to construct the inductor. Therefore, micro inductors using a combination of a low-resistance winding, i.e. copper in practical cases, in combination with magnetic material on top and bottom have become a popular alternative to air coils. In this case the winding is sandwiched between two magnetic layers. The resulting structure is relatively flat, which is an advantage over wire-wound structures, which are usually larger in volume. Moreover, the achieved specifications of sandwiched inductors as will be described below are quite useable in many practical DC/DC converters.

Depending on the used magnetic material, the inductance of the sandwiched inductor rolls of at a certain frequency, usually below 10 MHz. However, this may not be a problem for a range of applications, since the larger inductance value in the same volume compared to air coils ensures that lower switching frequencies below 10 MHz can be used. Used materials include permalloys, such as NiFe, and a wide range of ferrites, e.g. NiZn-ferrites. Key characteristics of the used material are its saturation magnetization (which can be directly translated into the saturation current through the minimum core cross section and the number of turns of the winding), its $\mu r \times$bandwidth product (Snoek's limit, specifying the permeability $\mu r$ at DC and the frequency at which it rolls off) and its electrical resistance. The latter value determines the core losses due to eddy currents induced by the magnetic field caused by the winding. A low-resistance material has the advantage of a large saturation magnetization and $\mu r \times$bandwidth product, but the disadvantage of high eddy-current losses. In case of using a low-resistance material, lamination and patterning should be applied to limit eddy currents and isolation layers should be applied between the magnetic films and the winding to prevent short-circuiting of the turns in the winding.

Saturation of the magnetic material is an issue, since it leads to a decrease in inductance as a function of the current through the winding. In fact, when the core material has fully saturated, its permeability μr has become 1, so the winding has the same inductance as an air coil with the same winding. However, the current at which saturation occurs can be influenced by using a controlled air gap in the flux path. This effectively reduces the permeability μr of the material, and therefore the inductance experienced at DC (0 Hz), but extends the bandwidth at which the material maintains this μr value (since the μr×bandwidth product remains fixed according to Snoek's limit) and increases the current through the coil at which the core material saturates.

Most state-of-the-art methods for manufacturing a sandwiched spiral coil integrate the coil on top of the IC using post-processing steps. The invention aims to provide an inductor (with a sandwiched coil) which can be placed below or on top of an active die in order to provide a way of making small-form-factor DC/DC converters.

According to one aspect the invention provides an inductive component for a DC/DC converter, the inductive component comprising a first plate of a magnetic material, an electrically conductive track attached to one surface of the first plate, and a second plate of a magnetic material which confronts said one surface of the first plate so that the track forms an inductor coil between the first and second plates, at least one of the plates having at least two holes or passages through which electrical connection is made to respective terminals of the inductor coil.

According to another aspect the invention provides a method of making an inductive component for a DC/DC converter, the method comprising forming a substrate with an electrically conductive track on one surface of a substrate, attaching the track to a first plate of a magnetic material by means of glue or adhesive, removing the substrate by an etching process to leave the conductive track on the first plate of magnetic material, and positioning a second plate of a magnetic material so that the track forms an inductor coil between the first and second plates, at least one of the plates having at least two holes or passages for making electrical connections with respective terminals of the inductor coil.

The pre-defined electrically conductive track on the first plate is preferably formed utilizing ultra-thin leadless package (UTLP) technology, a flip-chip version of which is disclosed in US Patent Specification 20070052097 A1. The track can then be transferred to the first plate by gluing followed by removing the metal substrate with chemical etching. This makes it possible to transfer the tracks to ferrite plates, or plates of any other suitable magnetic material. The tracks can be accessed by holes in the ferrite plates. These holes can be made by sandblasting or laser drilling. Preferably, the track and substrate are made of copper.

The method of constructing the coil in this manner also leaves freedom in choosing some important inductor properties in a simple way. For example, the air gap inside and outside the winding is simply determined by the distance between the ferrite plates. Therefore, by properly choosing the track height and optionally by adding an insulating foil on top of and below the track, the spacing between the ferrite plates and therefore the air gap can be controlled. Optionally, this gap between the ferrite plates can be made smaller by adding ferrite material in the air gaps. This can be done by intermediate gluing steps of ferrite parts in the same plane as the tracks. Alternatively, the air gaps can be filled with a resin/ferrite mixture. If a sealant is put around the coil and the inner space is sucked vacuum, removing the sealant will cancel the vacuum after which the resin/ferrite mixture is sucked into the open air gaps. As mentioned above, controlling the air gap is beneficial in determining both the frequency-dependence of the inductance as well as the saturation current. Adding ferrite in the air gaps will decrease the leakage flux (advantageous for EMI) and will increase the inductance.

In one preferred embodiment, at least one of the plates is formed with a recess accommodating the coil, so that the plates abut with a very small air gap therebetween. The two pates may be glued together with only the distance of the glue layer between. The air gap can then be only a few microns, which may be beneficial in having a high inductance but still achieving the positive effects of an air gap. Another advantage is the lower fringe field along the edges of the devices, since the air gap is smaller. This is a positive impact on EMI behaviour.

The manufacturing process, of which some examples are described subsequently, can also be adapted such that a patterned ferrite plate is glued on the track. This helps to reduce eddy current losses. The necessity for this depends on the magnetic material used, since the higher electrical resistance of this material, the lower the need for patterning becomes.

For increased inductance, a stacked winding can also be used. This is achieved by soldering together two windings backed by ferrite plates.

The invention includes within its scope a plurality of inductive components, each in accordance with said one aspect of the invention, borne by a common support layer and a method of making such a plurality of inductive components. This allows the manufacturing of multiple non-coupled micro inductors simultaneously, which is beneficial for keeping manufacturing cost low. The realized micro conductors are intended to be used for integrated power management, where a plurality of individual inductive DC/DC converters are integrated with the load in a single IC package. Various blocks of the load may be given their individual efficient integrated power supply in the form of an integrated DC/DC converter. Combining an active die, including the loads to be supplied by the integrated DC/DC converters and the active parts (power stages, control loop, drivers) of these integrated DC/DC converters, with the substrate containing the coils yields a Chip-Scale-Package (CSP) or System-in-Package (SiP).

Figure 2:
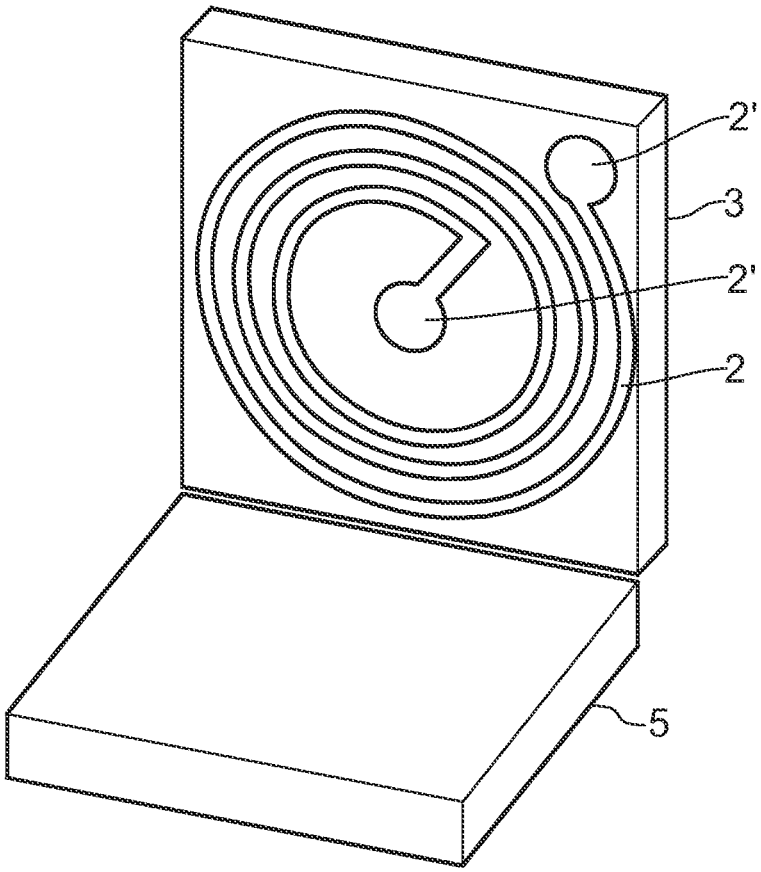
Figure 3:
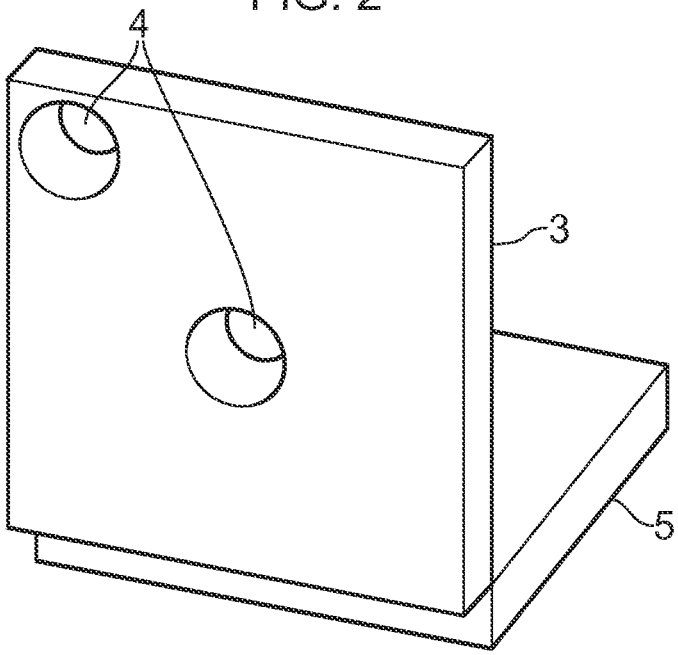
Figure 4:
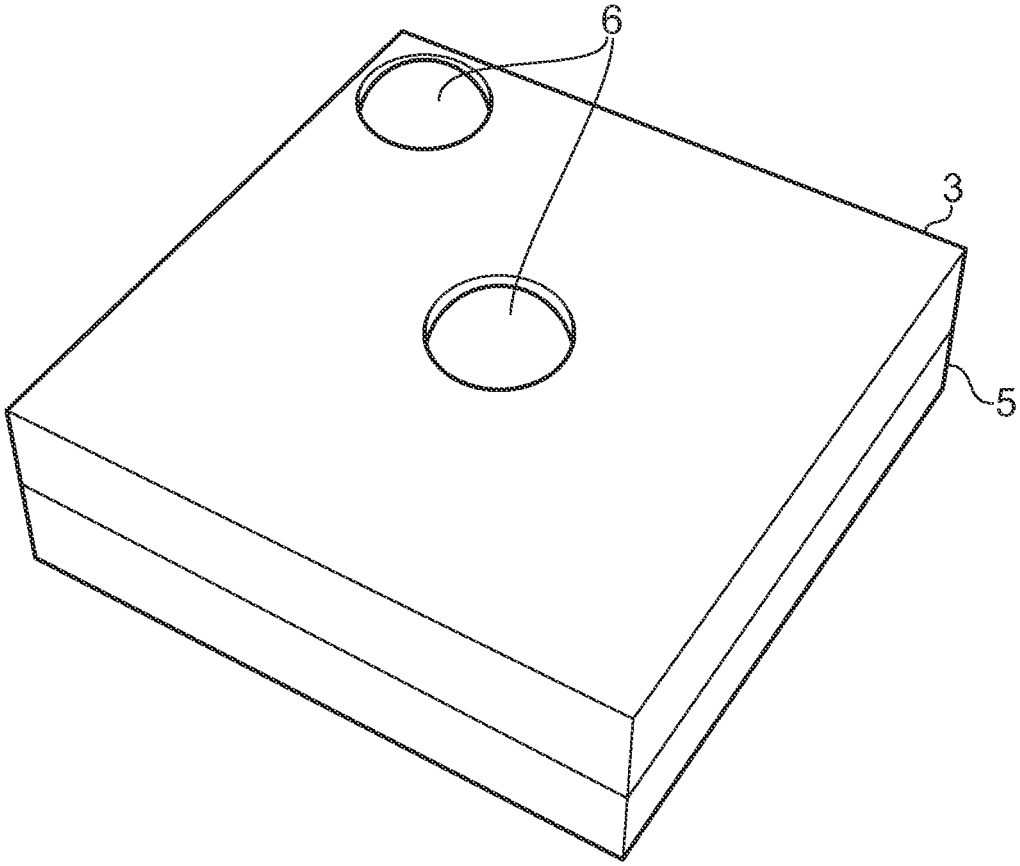
Figure 7:
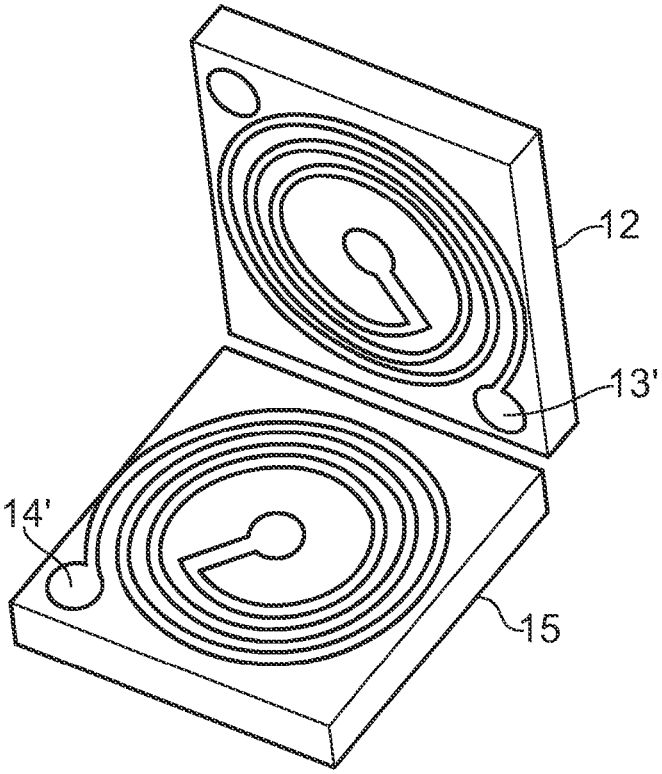
Figure 8:
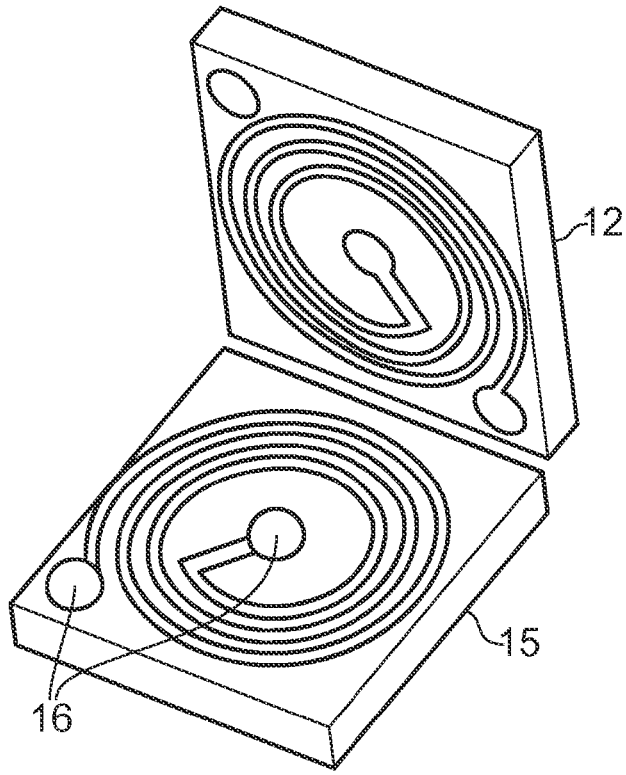
Figure 9:
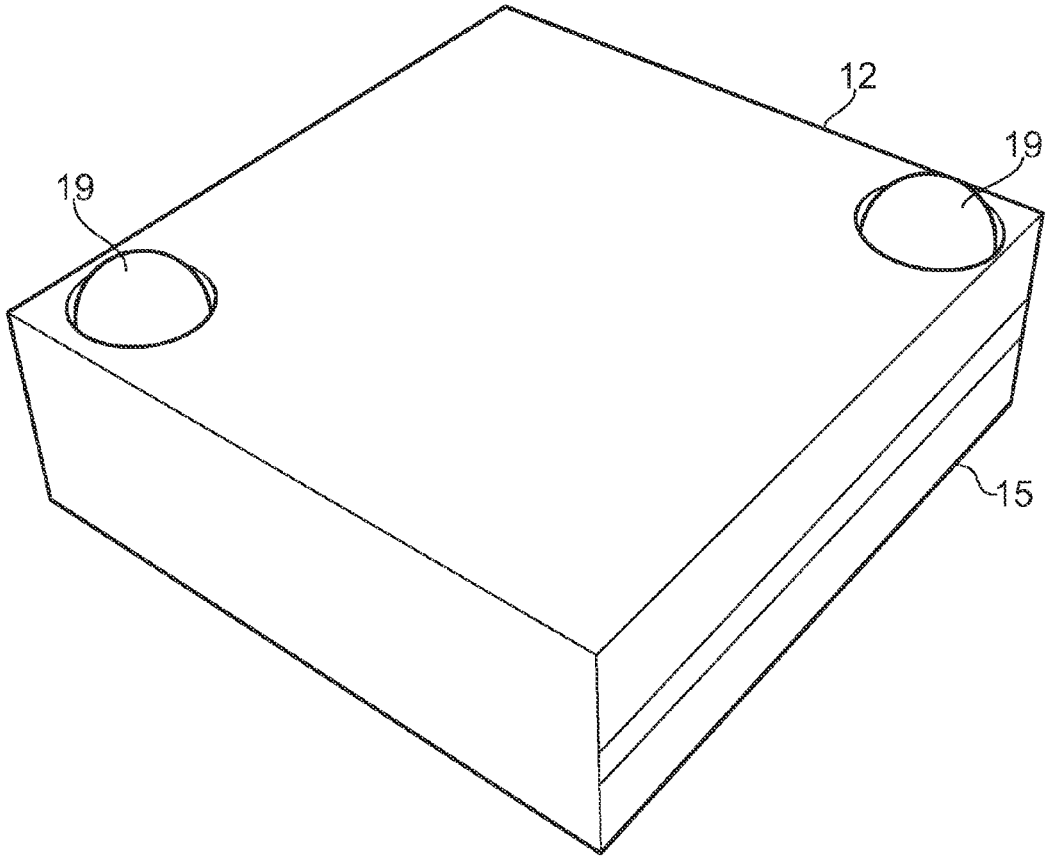
Figure 10:
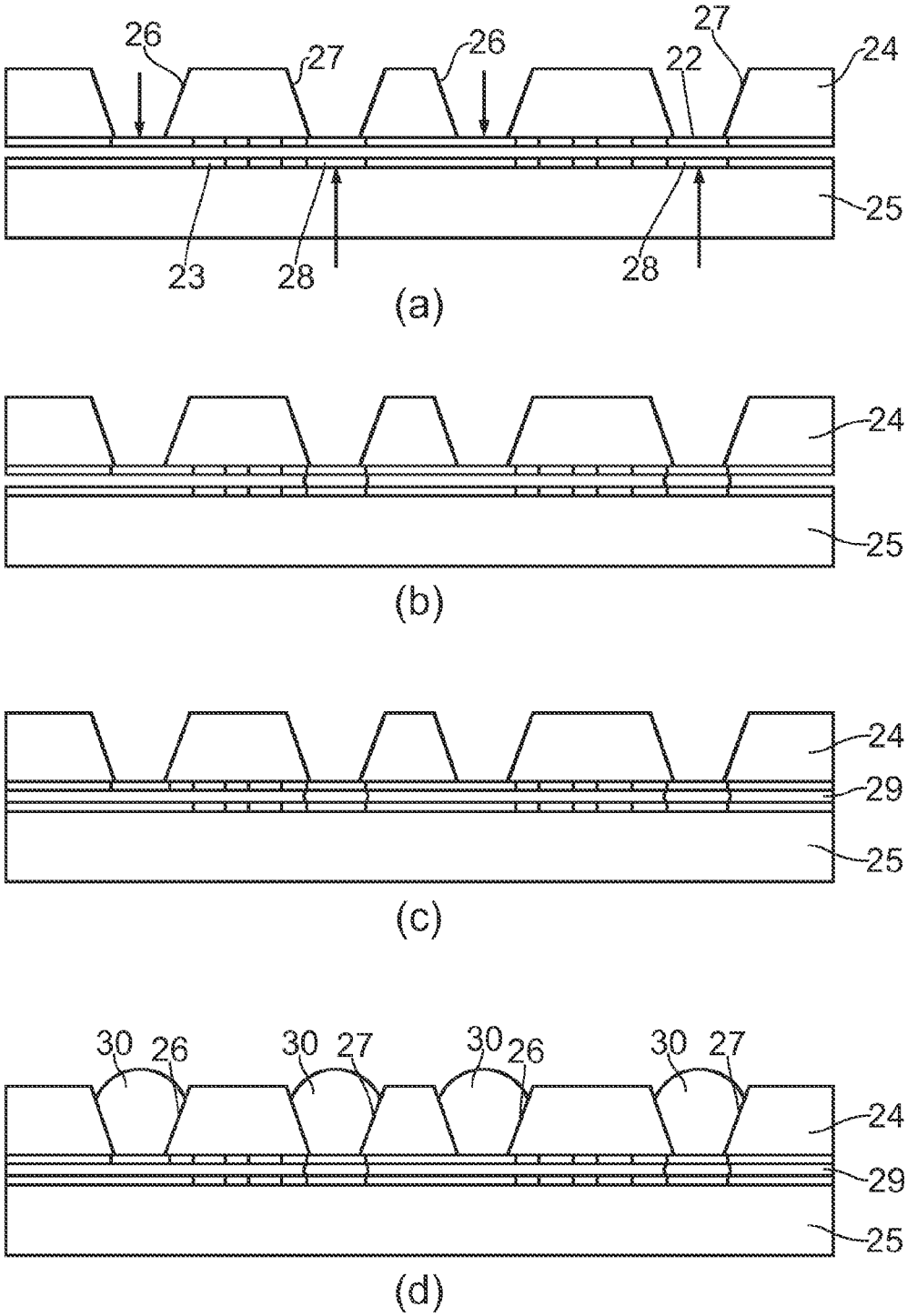
Figure 11:
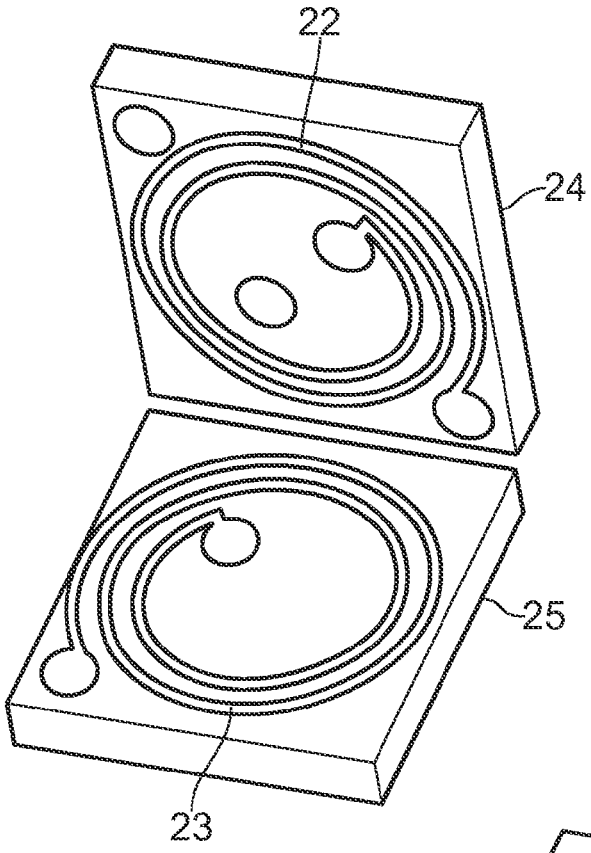
Figure 12:
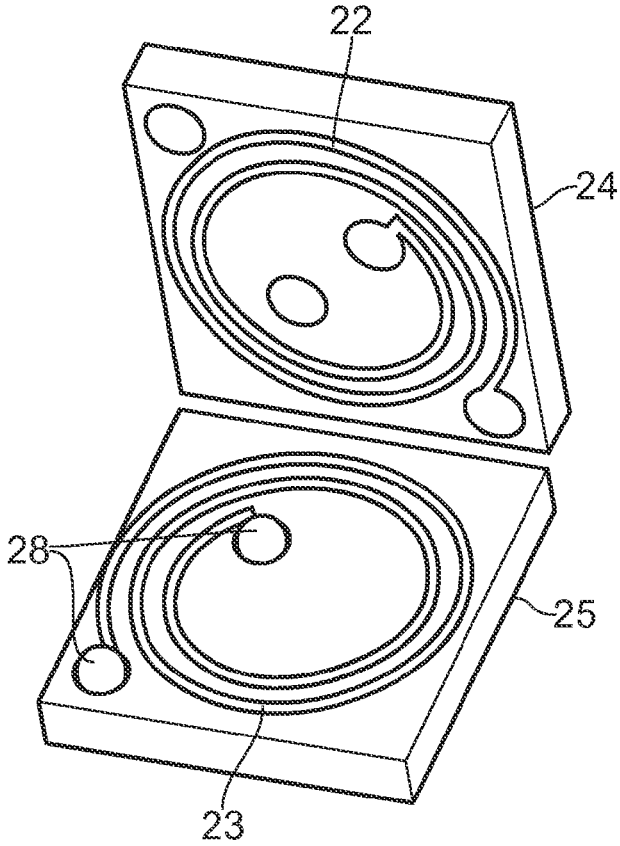
Figure 13:
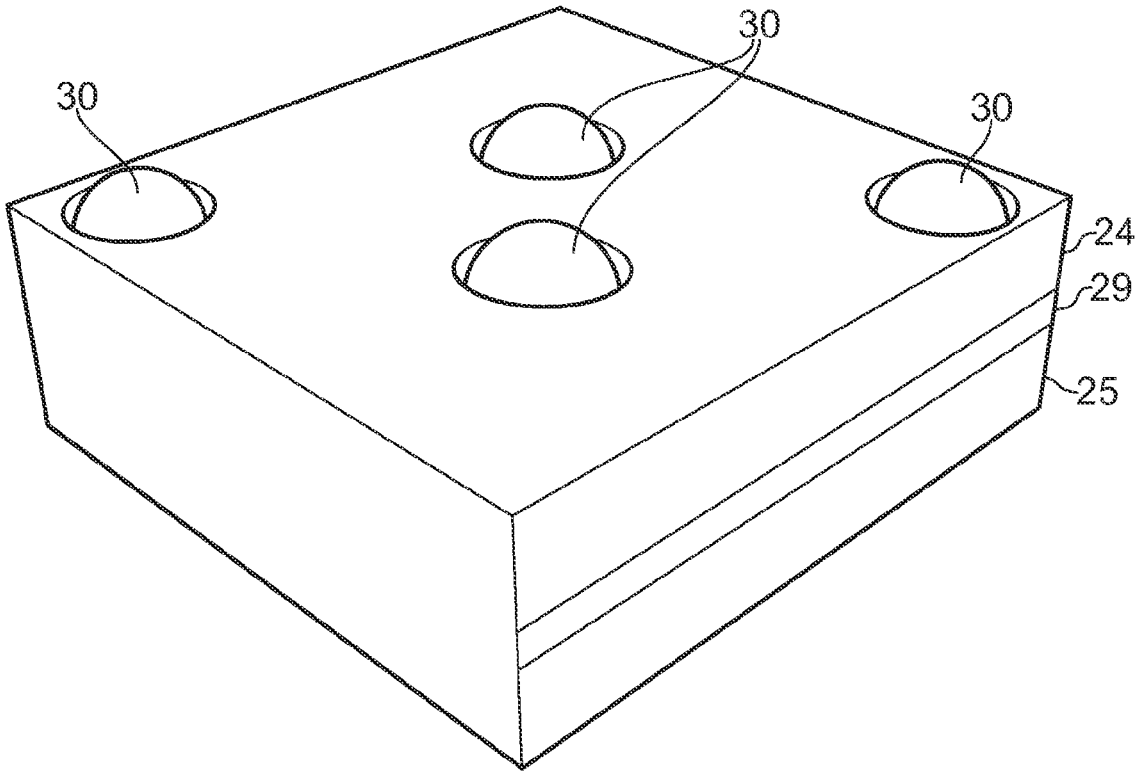
Figure 19:
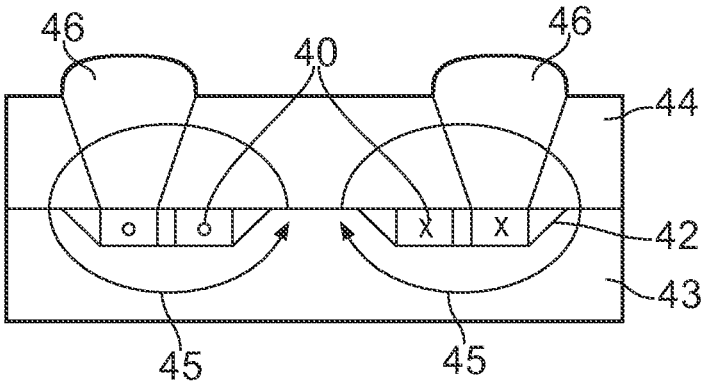
Figure 20:
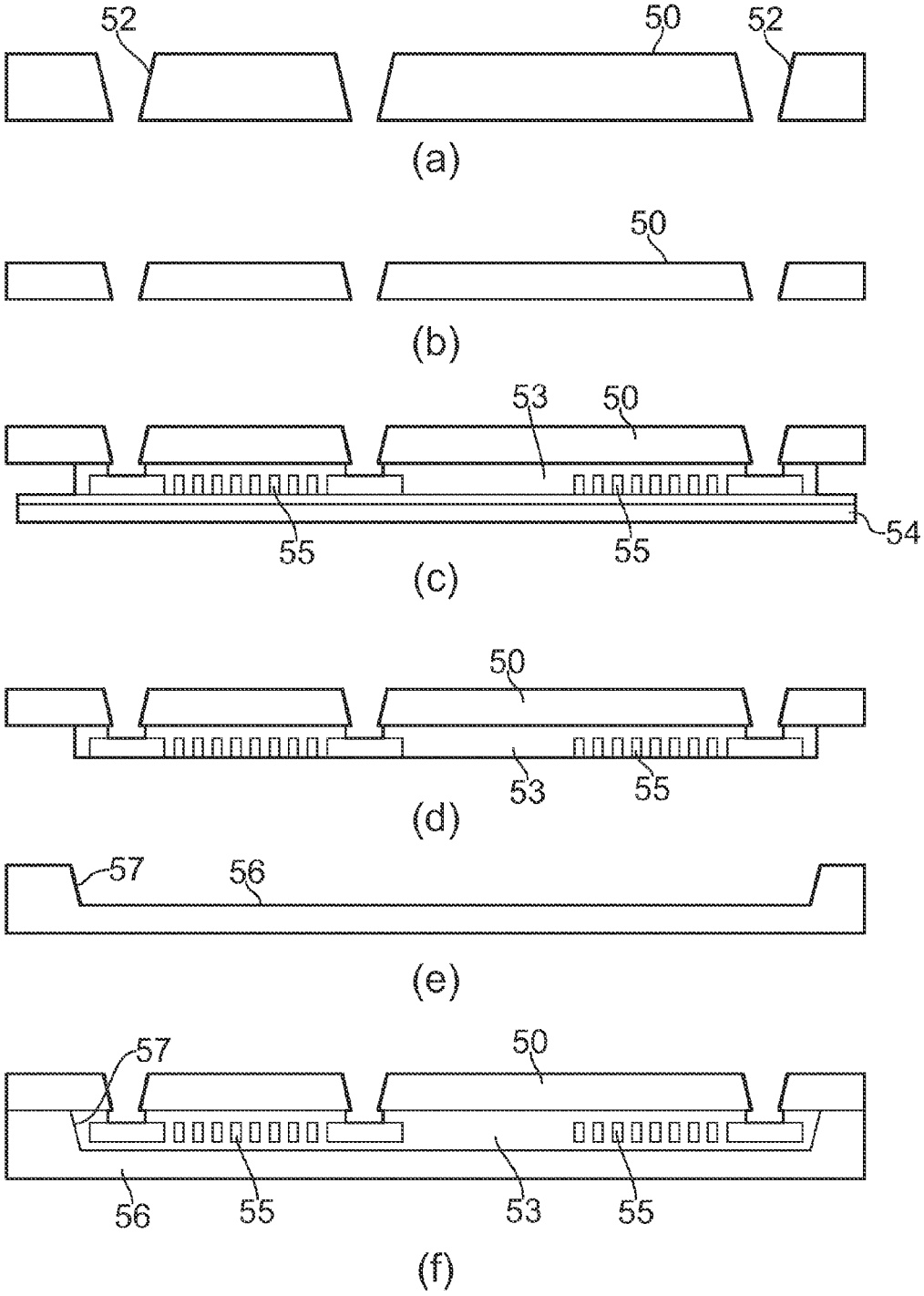
Figure 20:
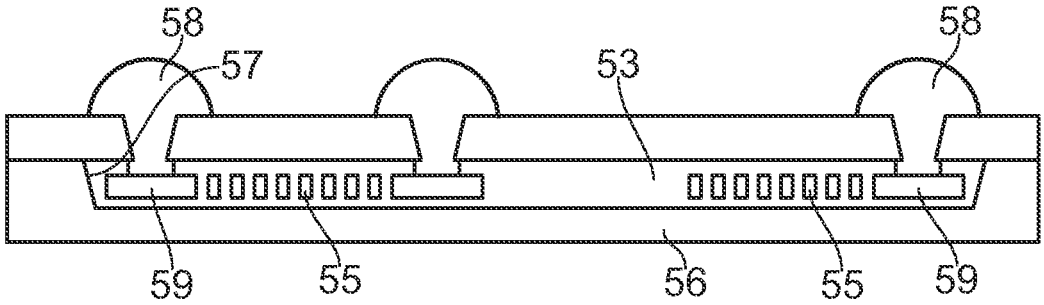
Figure 20:
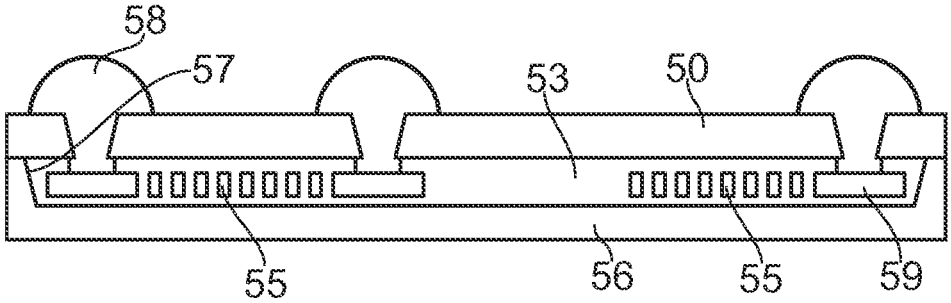

Embodiments of the invention will now be described by way of example and with reference to the accompanying schematic drawings, wherein:

FIG. 1, consisting of individual cross-sectional views (a) to (e), shows the steps in the manufacture of a first embodiment having a single inductor coil, FIGS. 2 and 3 are isometric front and back views of the component of FIG. 1 at an intermediate stage of manufacture, FIG. 4 is an isometric view of the component of FIGS. 1 to 3, FIG. 5 illustrates a modification of the embodiment of FIGS. 1 to 4, FIG. 6, consisting of individual cross-sectional views (a) to (d), shows the steps in the manufacture of a second embodiment having a pair of inductor coils, FIGS. 7 and 8 are isometric front views showing two intermediate stages in the manufacture of the second embodiment, FIG. 9 is an isometric view of the second embodiment of FIGS. 6 to 8, FIG. 10, consisting of individual cross-sectional views (a) to (d), shows the steps in the manufacture of a third embodiment having two coils forming transformer windings, FIGS. 11 and 12 are isometric front views showing two intermediate stages in the manufacture of the third embodiment, FIG. 13 is an isometric view of the third embodiment, FIGS. 14 to 18 show how the invention may be used to provide multiple inductive components, FIG. 19 is a diagrammatic cross-sectional view of a fourth embodiment, and FIG. 20, consisting of individual cross-sectional views (a) to (h), shows the steps in the manufacture of a fifth embodiment.

FIG. 1 illustrates the stages in the manufacture of an inductive component for a DC/DC converter.

A copper substrate 1 carries a copper track 2 in the shape of a spiral, by using ultra-thin leadless packaging technology. The side of the substrate 1 carrying the track 2 is then attached by glue or adhesive to one surface of a first ferrite plate 3 which has two tapering through bores (or via holes) 4 so positioned as to register with the two end terminals of the spiral copper track 2. The copper substrate 1 is then removed by an etching process, to leave the copper track 2 on the ferrite plate 3. The holes 4 are formed by sandblasting or laser drilling.

A second ferrite plate 5 is attached to the track 2, again by glue or adhesive. As a result, the track 2 is sandwiched between the two ferrite plates 3 and 5 with the two end terminals 2' (FIG. 2) of the track accessible through the respective holes 4 in the first ferrite plate 3. The glue used to glue the ferrite plates together may be Namics Chipcoat UF 8443. Solder balls 6 are introduced into the holes 4 to form externally accessible contacts for the inductive component.

FIGS. 2 and 3 show the component at the stage between FIGS. 1*c* and 1*d*, that is immediately before attachment of the second ferrite plate to the surface of the first ferrite plate bearing the track. The holes 4 register with the end terminals 2'.

The completed inductive component is illustrated in FIG. 4. The inductive component shown has length, breadth and thickness dimensions of 2 mm, 2 mm and 0.7 mm respectively. The track has breadth and thickness dimensions of 60 and 25 microns respectively. Other dimensions are of course also possible.

Figure 5:
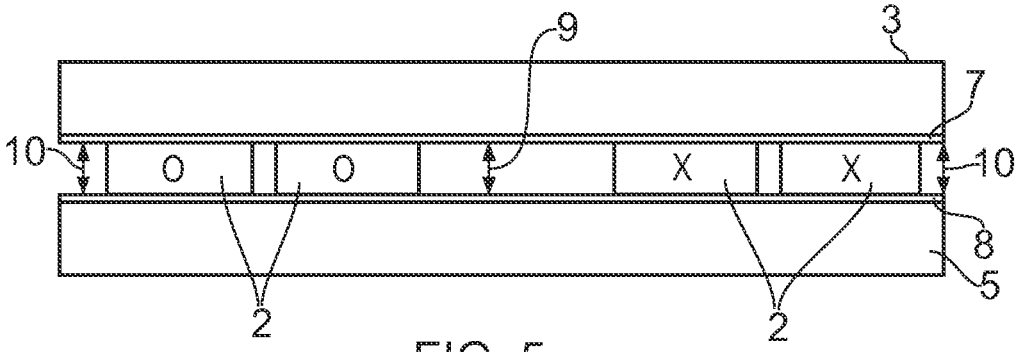
Figure 6:
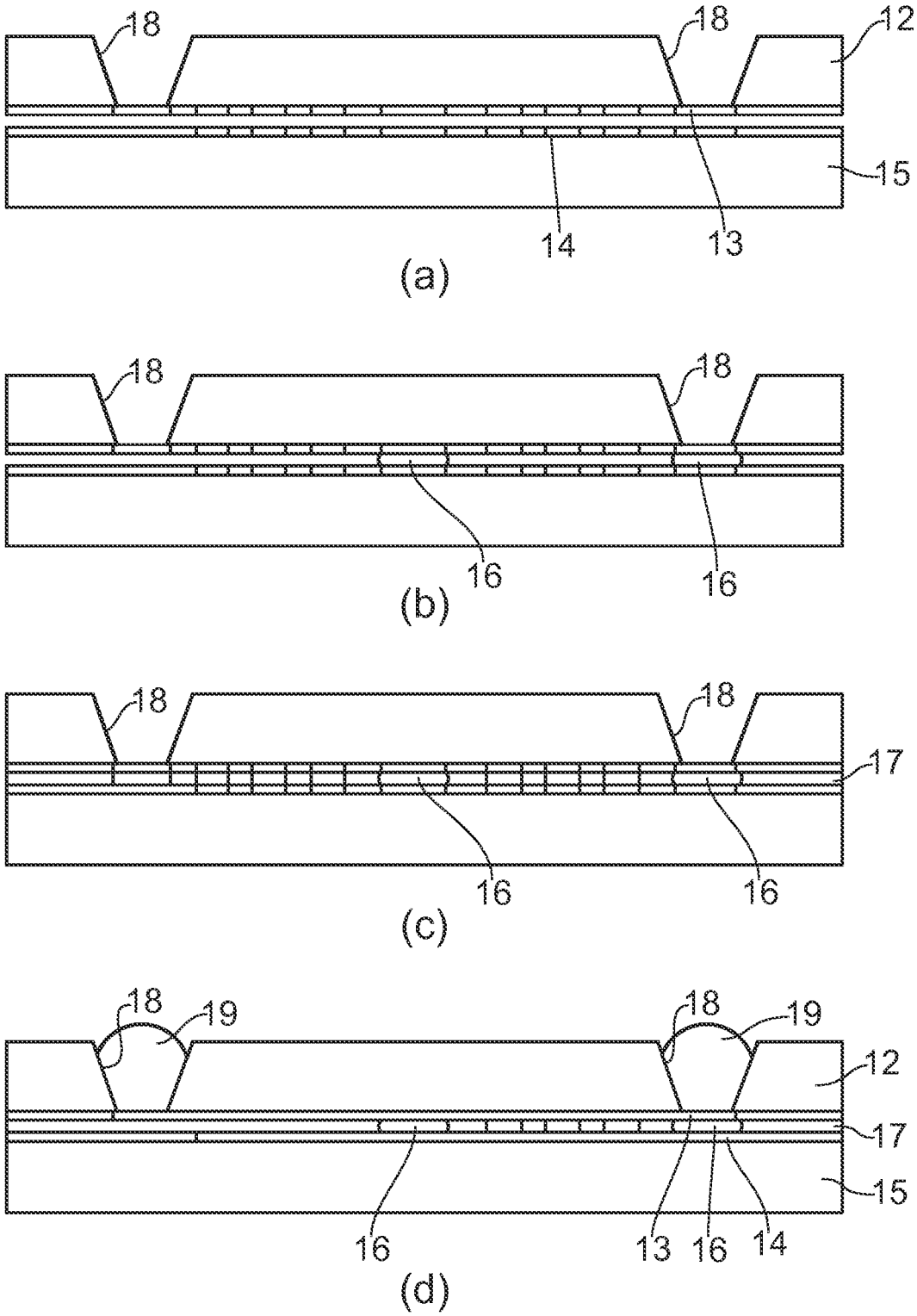

FIG. 5 illustrates a modification of FIG. 1 where insulating foil layers 7 and 8 are positioned on respective sides of the track 2, that is between the track 2 and the ferrite plate 3 and between the track 2 and the ferrite plate 5. The left-hand pair of turns of the track 2 show current flowing out of the plane of FIG. 5 and the right-hand pair of turns show current flowing into the plane of FIG. 5. The inner and outer air gaps 9 and 10 between the plates 3 and 5 can be dimensioned as desired by appropriate choice of thickness of the track 2 and the thickness of the optional foil layers 7 and 8. Also, the effective air gap between the plates 3 and 5 can be reduced by the addition of ferrite material in the space between the plates 3 and 5.

FIGS. 6 to 9 show the second embodiment. Referring to FIG. 6*a*, a first ferrite plate 12 carries on one surface a spiral copper track 13 similar to the track 2 of FIG. 1. The track 13 is transferred from a copper substrate to the plate 12 by a process which corresponds to that previously described, that is the substrate/track combination is glued to the plate and the substrate subsequently removed by etching.

The same method is used to transfer a second copper spiral track 14 from a copper substrate (not shown) on to a second ferrite plate 15. The two ferrite plates 12 and 15 are glued together and two solder bumps 16 act to connect the two tracks in series to form a double layer coil sandwiched between the two plates 12 and 15. The spaces between the tracks may be filled with ferrite material 17. The first plate 12 has two tapering holes 18 providing access to respective end terminals 13', 14' (FIG. 7) of the double layer coil and these holes 18 are filled with solder balls 19 which serve as externally accessible contacts for the double layer coil.

FIGS. 7 and 8 show how the two ends of the two spiral tracks register and are inter-connected by the solder bumps 16.

The inductive component shown in FIGS. 10 to 13 also has two spiral copper tracks 22, 23 carried by respective ferrite plates 24, 25 but in this case the two tracks 22, 23 are separate coils and act as transformer windings sandwiched between the two ferrite plates 24, 25. Thus, FIG. 10*a* shows the first composite body (ferrite plate with spiral copper track) positioned above the second composite body (ferrite plate with spiral copper track). Each track is transferred from a corresponding substrate to the relevant ferrite plate by the method described with reference to FIG. 1.

The first plate 24 has four through holes, a first pair 26 of which provide access to respective terminals of the first track and the second pair 27 of which provide access to respective terminals of the second track. The two terminals of the second track have conductive pads 28 which are respectively aligned with the second pair of holes 27. The second winding is soldered to isolated pads in the same layer as the first winding. Thus, when the composite bodies are inter-connected by means of glue and solder, access to the pads is possible through the holes. The gaps between the plates may then be filled with ferrite material 29, if desired and finally the holes are filled with solder balls 30 so that the component has four accessible contacts for electrical connection to the two coils.

An inductive component according to the invention is intended to be mounted on an active die (with power switches and control circuitry) to provide a system-in-package (SiP). Alternatively, the inductive component may be mounted next to a flip-chipped active die on other UTLP substrate to form a UTLP package including active die and integrated inductor.

Figure 14:
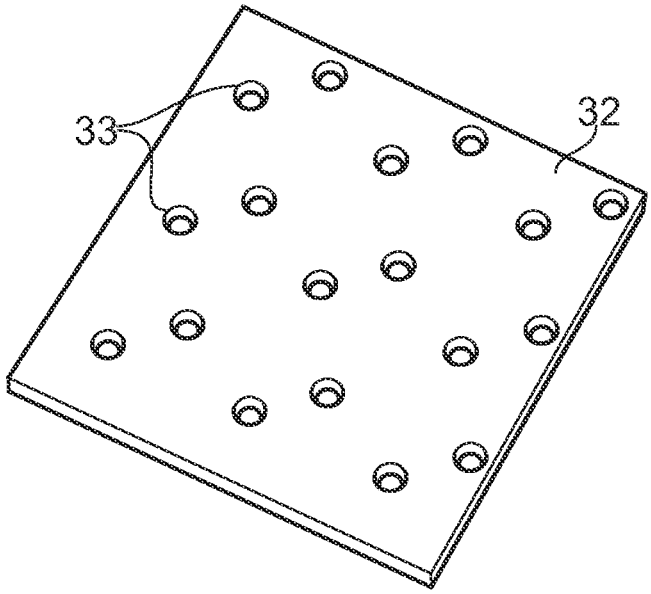
Figure 16:
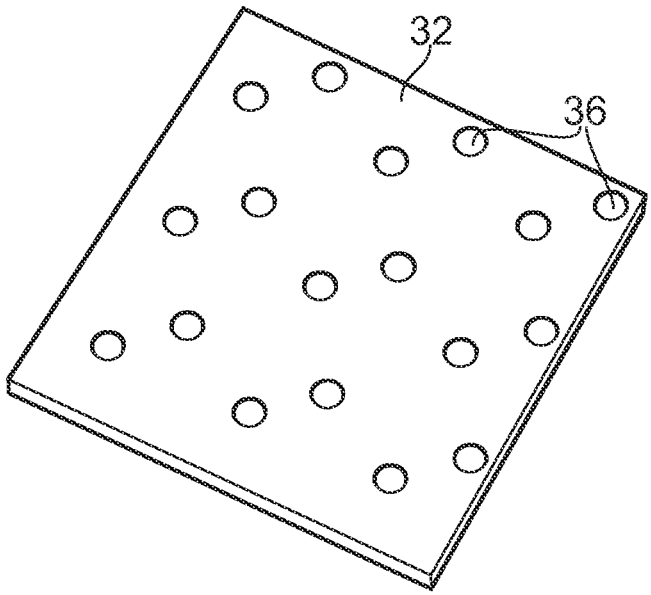
Figure 15:
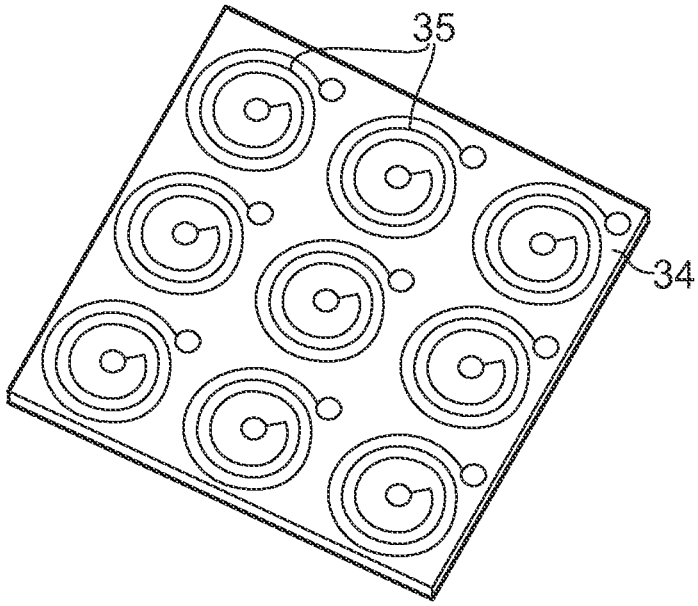
Figure 17:
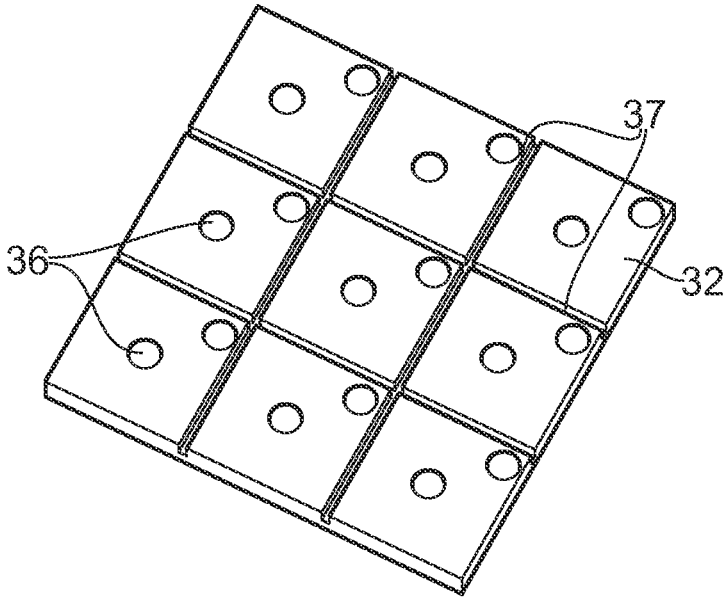
Figure 18:
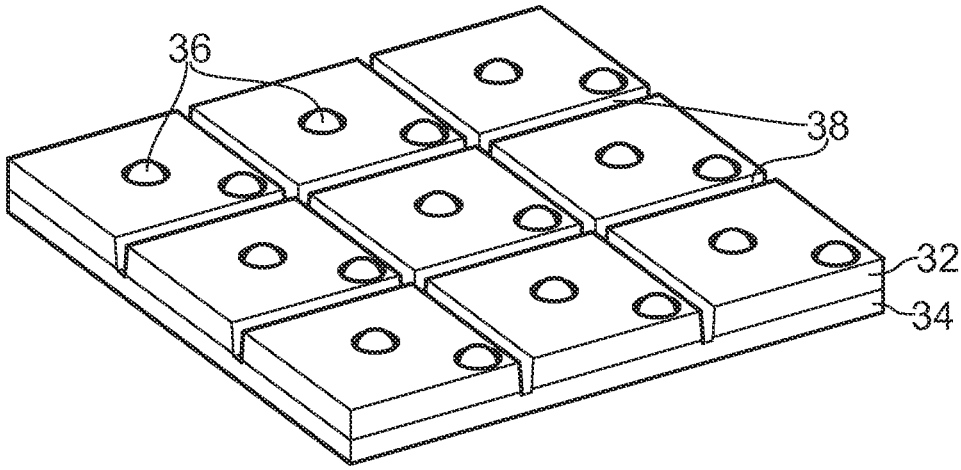

FIGS. 14 to 18 illustrate how a plurality of inductive components, each corresponding to any one of the previous embodiments, may be made into multiple inductive components. FIG. 14 shows a first ferrite plate 32 having a plurality of sandblasted holes 33, positioned to register with coil terminals. FIG. 15 illustrates the second ferrite plate 34 having a plurality (in this case 9) of electrically conductive tracks 35 forming coils arranged in a symmetrical rectangular array. In the illustrated case the tracks 35 have identical shapes but could be different depending on the required configuration for the individual coils. After attaching the plates 32 and 34 together by means of glue or adhesive, the holes 33 are filled with solder balls 36 (FIG. 16) and the first plate 32 is formed with transverse cuts 37 by sawing or grinding so as to separate the individual inductive components, as shown by FIG. 17. Transverse cuts 38 (FIG. 18) may be made by sandblasting in order to isolate the individual inductor coils formed by the tracks 35. If desired, the structure shown in FIG. 16 can be mounted on an underlying support layer, in which case the cuts or grooves could extend through the thicknesses of both plates 32 and 34.

In the embodiment of FIG. 19, the turns 40 defining the coil are located in an annual recess 42 in the ferrite plate 43. Therefore, a very small air gap exists between upstanding regions of the plate 43 and the planar surface of the confronting ferrite plate 44 which is glued to the plate 43. Thus, almost the entire lengths of the flux paths 45 pass through the ferrite plates. This contrasts with the prior art, e.g. U.S. Pat. No. 6,828,670, where there is more leakage flux to interact with other parts of the system. Solder balls are shown at 46.

Referring to FIG. 20, a ferrite plate 50 has tapering holes 52 formed therein by powder blasting, FIG. 20(*a*). The plate 50 is ground, FIG. 20(*b*), to reduce its thickness in order to ensure that the cross-sectional area for the flux has the desired value. The plate 50 is attached by glue 53 to a foil having a copper substrate 54 carrying copper tracks 55, FIG. 20(*c*). The substrate 54 is then removed by etching, FIG. 20(*d*). A further ferrite plate 56 is shaped with a recess 57 which receives the tracks 55 when the sub-assembly of FIG. 20(*d*) is glued to the plate 56. This stage is shown in FIG. 20(*f*). Solder balls 58 are applied to the holes 52, FIG. 20(*g*) with the balls 58 in contact with terminals 59 of the tracks 55 and the ends of the assembly are diced as illustrated in FIG. 20(*h*). Compared to FIGS. 1 to 4, one additional hole is used, which is one of the outer holes 52 in ferrite plate 50. This hole ends on a floating pad in structure 55, which is not connected to the coil winding. The solder ball with which this hole is filled serves as an additional pin on the device for increased mechanical stability when placing the inductor on an active die or other substrate. This pin therefore has no electrical function.

It will be appreciated that in each of FIGS. 19 and 20, the formation of the track between the pair of ferrite plates corresponds to the method previously described for earlier embodiments.

It should be noted that the figures are diagrammatic and not drawn to scale. Relative dimensions and proportions of parts of these figures have been shown exaggerated or reduced in size, for the sake of clarity and convenience in the drawings. The same reference signs are generally used to refer to corresponding or similar features in modified and different embodiments.

From reading the present disclosure, other variations and modifications will be apparent to persons skilled in the art. Such variations and modifications may involve equivalent and other features which are already known in the art, and which may be used instead of or in addition to features already described herein.

Although claims have been formulated in this application to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The applicants hereby give notice that new claims may be formulated to such features and/or combinations of such features during the prosecution of the present application or of any further application derived therefrom.

The invention claimed is:

1. An inductive component comprising:

a first plate of a magnetic material, an electrically conductive track attached to one surface of the first plate, and a second plate of a magnetic material which confronts said one surface of the first plate so that the track forms an inductor coil being situated between the first and second plates and including an inner-coil air gap having a thickness defined along an axis extending orthogonally also between the first plate and the second plate, at least one of the plates having at least two holes or passages through which electrical connection is made to respective terminals of the inductor coil.

2. The inductive component according to claim 1, wherein the holes or passages are filled with an electrically conducting material such as solder.

3. The inductive component according to claim 1, wherein the second plate is attached to the track with glue or adhesive, the plates being separated by a predetermined distance that sets the thickness.

4. The inductive component according to claim 1, wherein at least one of the plates is formed with a recess accommodating the coil so that the plates abut with a very small air gap there between.

5. The inductive component according to claim 1, wherein the inductor coil has two layers, namely a first layer formed by the conductive track on the first plate and a second layer formed by a second electrically conductive track on the second plate, the first and second layers being connected in series by electrical connections which register with the ends of the two layers and which are positioned between the two plates.

6. The inductive component according to claim 1, wherein the coil is one of a pair of coils constituting transformer windings, the second coil being formed by conductive tracks on the second plate, at least one of the plates having at least four holes through which electrical connection is made with respective ends of each coil.

7. The inductive component according to claim 1, wherein the electrically conductive track is one of a plurality of such conductive components borne by a common support layer.

8. A plurality of inductive components according to claim 7 wherein the components are arranged in a rectangular array.

9. A plurality of inductive components according to claim 7 wherein one of the plates forms the common support layer.

10. An apparatus comprising: the inductive component according to claim 1 and a DC/DC converter.

11. The inductive component according to claim 1, wherein the second plate is attached to the conductive track by glue or adhesive.

12. The inductive component according to claim 1, wherein the second plate is attached to the conductive track and wherein a first layer of insulating foil is interposed between the conductive track and the first plate, and a second layer of insulating foil is interposed between the conductive track and the second plate.

13. The inductive component according to claim 1, wherein the inductor coil has two layers, a first layer formed by the conductive track on the first plate and a second layer formed by a second conductive track on the second plate, the first and second layers being connected in series by electrical connections which register with the ends of the two layers and which are positioned between the two plates.

14. The inductive component according to claim 1, wherein the coil is one of a pair of coils constituting transformer windings, the second coil being formed by conductive tracks on the second plate, at least one of the plates having at least four holes for making electrical connection with respective ends of each coil.

15. An apparatus including a plurality of inductive components, each of the inductive components according to claim 1, and wherein the first plate carries a plurality of tracks which then form a plurality of coils between the first and second plates, at least one of the plates having a plurality of pairs of holes for making electrical connection with the respective plurality of the coils.

16. The inductive component according to claim 15, wherein the plate having holes is sub-divided by cuts and wherein the sub-divided areas are in registration with the individual coils.

17. The inductive component according to claim 1, wherein the holes or passages are formed by sandblasting or laser drilling.

18. An inductive component according to claim 1 and manufactured by: forming a substrate with an electrically conductive track on one surface of the substrate, attaching the track to a first plate of a magnetic material with glue or adhesive, removing the substrate by an etching process to leave the conductive track on the first plate of magnetic material, and positioning a second plate of a magnetic material so that the track forms an inductor coil between the first and second plates, at least one of the plates having two holes or passages for making electrical connection with respective terminals of the inductor coil.

19. A plurality of inductive components, each according to claim 1 and wherein one of the plates forms a support layer which is configured and arranged to provide a support layer that is common to each of the plurality of inductive components.

20. The inductive component according to claim 2, wherein the second plate is attached to the track with glue or adhesive, the plates being separated by a predetermined distance.

* * * * *